US007314494B2

(12) United States Patent
Shvartsman et al.

(10) Patent No.: US 7,314,494 B2
(45) Date of Patent: Jan. 1, 2008

(54) ANTI-DETONATION ADDITIVE, AND FUEL PROVIDED THEREWITH

(75) Inventors: Leonid Shvartsman, Kharkov (UA); Anatoly Potik, Roslyn, NY (US); Ashok Chakram, Kharkov (UA); Borys Zamotaylov, Kharkov (UA)

(73) Assignee: AAA Commerce Worldwide, Inc., New York, NY (US)

( * ) Notice: Subject to any disclaimer, the term of this patent is extended or adjusted under 35 U.S.C. 154(b) by 0 days.

(21) Appl. No.: 11/045,659

(22) Filed: Jan. 31, 2005

(65) Prior Publication Data

US 2006/0168877 A1 Aug. 3, 2006

(51) Int. Cl.
*C10L 1/18* (2006.01)

(52) U.S. Cl. ..... 44/385; 44/451

(58) Field of Classification Search ..... 44/385, 44/451

See application file for complete search history.

(56) References Cited

U.S. PATENT DOCUMENTS

| | | | | |
|---|---|---|---|---|
| 3,490,237 | A * | 1/1970 | Lissant | 60/217 |
| 4,405,337 | A * | 9/1983 | Mori | 44/308 |
| 4,603,662 | A * | 8/1986 | Norton et al. | 123/1 A |
| 4,929,252 | A * | 5/1990 | Brillhart | 44/308 |
| 2002/0178650 | A1 * | 12/2002 | Ikura et al. | 44/438 |

FOREIGN PATENT DOCUMENTS

| | | | |
|---|---|---|---|
| WO | WO9812042 | * | 3/1998 |

* cited by examiner

*Primary Examiner*—Cephia D. Toomer
(74) *Attorney, Agent, or Firm*—I. Zborovsky

(57) ABSTRACT

An anti detonation additive for fuel includes ethyl alcohol, and a stabilizer which contains ricinoleic acid. Also a fuel is provided with this anti-detonation additive.

1 Claim, No Drawings

ANTI-DETONATION ADDITIVE, AND FUEL PROVIDED THEREWITH

BACKGROUND OF THE INVENTION

The present invention generally relates to petrochemical industry, and can be used in fuels, preferably for internal combustion engines.

It is known to use water-containing ethyl alcohol as an anti-detonation additive for fuels, in particular gasoline. In order to increase stability of the properties of the fuel when such an additive is introduced into it, mixtures including stabilizing substances, for example emulsifiers are utilized.

An anti-detonation additive or mixture is known, which is based on ethyl alcohol, with the addition of an emulsifier in form of aqueos ammonium solution of casein, etc. (V. M. Ivanov, B. V. Kantorovich "Fuel Emulsions and Suspensions"), M., Metallurgizdat, 1963, pages 24-28). These mixtures however are not sufficiently effective because the fuel with this mixture has low stability (only several hours), it has a low dispersion (diameter of drops of water about 2 mcm), and also has an increased viscosity.

An anti-detonation additive for fuel is known, based on a water containing ethyl alcohol, which includes a stabilizer as disclosed in patent document RU 2 068 871 1995. The mixture is used as a high-octane additive for fuels, predominantly for internal combustion engines, and it has wastes of hydraulic manufacture of ethyl alcohol from wooden initial material. This mixture is inexpensive and can increase a phase stability of fuel. However, the production of this high-stability and uniform fuel emulsion is difficult, because water which is contained in the alcohol is not completely blocked.

SUMMARY OF THE INVENTION

Accordingly, it is an object of the present invention to provide an anti-detonation additive for fuels, and a fuel provided with the same, which avoid the disadvantages of the prior art.

In keeping with these objects and with others which will become apparent hereinafter, one feature of the present invention resides, briefly stated, in an anti-detonation additive for fuel, comprising ethyl alcohol; and a stabilizer which contains ricinoleic acid.

Another feature of the present invention resides, briefly stated, in a fuel for internal combustion engines, comprising gasoline; and anti-detonation additive including ethyl alcohol, and a stabilizer which contains ricinoleic acid.

When the anti-detonation additive is formed in accordance with the present invention, its efficiency when introduced into a fuel is increased, in particular by providing a substantially full blocking of a hydroxilic group in it.

The fuel with the anti-detonation additive in accordance with the present invention has increased operational properties, including an increase of its stability in time, reduction of temperature of turbidity, reduction of viscosity, and increase of energy properties.

The novel features which are considered as characteristic for the present invention are set forth in particular in the appended claims. The invention itself, however, both as to its construction and its method of operation, together with additional objects and advantages thereof.

DESCRIPTION OF THE PREFERRED EMBODIMENTS

In accordance with the present invention an anti-detonation additive is proposed. The additive is based on ethyl alcohol, with addition of a stabilizer, wherein the stabilizer contains ricinoleic acid.

Ricinoleic acid ($C_{18}H_{34}O_3$) is contained in oil of castor seeds. It has molecular mass 298.47, density 0.950, melting temperature 4-5° C., boiling temperature 228° C.

In accordance with the present invention, the anti-detonation additive includes the following components, in volume percent:

| | |
|---|---|
| ricinoleic acid | 3–5 |
| water-containing ethyl alcohol | 97–95 |

In accordance with the present invention a fuel for internal combustion engine based on gasoline contains the above-mentioned inventive anti-detonation additive with the quantity of 1-1.4 volume percent of the anti-detonation additive per unit of increase of the octane number of gasoline.

In the inventive anti-detonation additive the ricinoleic acid is an efficient emulsifier. As a composite non-alcohol component, it provides blocking of a hydroxcylic group OH (water), in the molecule C2H5OH of the water-containing alcohol.

The ricinoleic acid is relatively inexpensive when compared with other vegetable oils. It does not have either hydrophilic or hydrophobic properties. It is easily soluble both in alcohol and in gasoline.

The use of the ricinoleic acid makes possible reliable blocking of water in the alcohol, provides high anti-corrosion properties of fuel, and significantly reduces temperature of its turbidity. The ricinoleic acid has high viscosity and is not subjected to drying, which makes it convenient for storage and use.

The content of the ricinoleic acid in the anti-detonation additive has to be maintained within 3-5 volume percent, since otherwise properties of the additive worsen when the quantity of the ricinoleic acid is beyond the above presented limits, and the above mentioned technical result is not achieved. The minimal quantity of the ricinoleic acid, namely 3 weight percent, is added into the water-containing ethyl alcohol in spring-summer period, while the maximum quantity of the ricinoleic acid 5 volume percent is introduced in spring-winter period when temperature of the environment is mainly negative.

The proposed quantity of the anti-detonation additive of 1-1.4 volume percent per unit of increase of octane number of gasoline is selected to provide the most efficient action of the additive as an emulsifier that provides the highest possible homogenuity and decree of dispersion of the fuel. A quantity of the units of increase of the octane number when compared with an initial gasoline, for which can be used for example a gas-condensate gasoline, a cracking gasoline, etc., preferably does not exceed 20. For example, in order to increase the octane number of automobile gasoline A71 (Al-80) which is equal to 76 in accordance with a motor method, by 12 units, or in other words to convert it into the gasoline Al 93 with the octane number 85, the quantity of the anti-detonation additive must be 13-18.2 volume percent.

In order to produce fuel with predetermined properties, its preparation includes mixing of components with the use of devices for dispersion of mixtures, which provides efficient mixing and high quality of obtained emulsion, for example by producing in a mixing chamber resonance phenomena with formation of turbulent pulsations and cavitation processes in the preparing emulsified fuel. The fuel obtained by dissolving the anti-detonation additive in gasoline is an alcohol-water-gasoline emulsion of the type "water-oil", which contains suspended drops of alcohol with water (dispersion phase), surrounded by elastic absorption-salivate layer.

During combustion of such micro-balls of fuel, water from alcohol evaporates and explodes an exterior casing from gasoline. The microexplosions generated during combustion of fuel provide intense pulverization of drops of fuel and their mixing with a charge of air in the cylinders of the engine. Therefore, the process of combustion of fuel becomes more efficient and occurs over a shorter time interval than with other fuels. Practically complete combustion takes place as a result of gasification of soot residuals of the fuel which have not burnt and which interact with water vapors contained in the alcohol.

The present invention is explained in the following example.

EXAMPLE

As an initial gasoline, a direct-distillation gasoline with octane number 70 in accordance with motor method is utilized. In order to increase the octane number by six units, the anti-detonation additive in the quantity of 8.4 volume percent is added to it. The characteristics of the obtained fuel are given in the following table.

TABLE 1

| | | | |
|---|---|---|---|
| Ethyl alcohol water-containing technical, volume % | 97 | 96 | 95 |
| Ricinoleic acid, volume % | 3 | 4 | 5 |
| Octane number in accordance with motor method | 76 | 76 | 76 |
| Stability not less than months | 12 | 12 | 12 |
| Temperature of turbidity, ° C. | −21 | −42 | −81 |
| Kinematic viscosity, cCT | 0.55 | 0.57 | 0.59 |
| Density, g/cm | 0.73 | 0.75 | 0.76 |
| Dispersion, mcm | 0.01 | 0.01 | 0.01 |

Reduction of the quantity of anti-detonation additive to 6 volume percent influences the characteristics of fuel insignificantly.

The anti-detonation additive which has the composition in accordance with the invention is significantly more efficient when compared with known additives. The fuel based on gasoline with the inventive anti detonation additive has high operational properties. It is stable (its properties do not worsen during not less than 12 months), it has low viscosity and low temperature of turbidity. The fuel is ecologically stable and corrosion stable. Its use in internal combustion engines increases efficiency of the engines by 4-6%, improves their economics, improves fuel economy, reduces quantity of toxic components and exhaust gasses.

It will be understood that each of the elements described above, or two or more together, may also find a useful application in other types differing from the types described above.

While the invention has been illustrated and described as embodied in an anti-detonation additive and a fuel provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel for internal combustion engines, comprising gasoline; and anti-detonation additive including water-containing ethyl alcohol, and a stabilizer which contains ricinoleic acid, wherein in the anti-detonation additive components are provided with the following ratio in volume percents:

ricinoleic acid 3-5, water-containing ethyl alcohol 97-95;

wherein a quantity of the anti-detonation additive is 1-1.4 volume percent per unit of increase of an octane number at the gasoline.

* * * * *